US008256891B2

(12) United States Patent
Kato

(10) Patent No.: US 8,256,891 B2
(45) Date of Patent: Sep. 4, 2012

(54) RECORDING APPARATUS

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 12/699,315

(22) Filed: Feb. 3, 2010

(65) Prior Publication Data

US 2010/0231675 A1 Sep. 16, 2010

(30) Foreign Application Priority Data

Mar. 10, 2009 (JP) ..... 2009-055948

(51) Int. Cl.
*B41J 2/01* (2006.01)

(52) U.S. Cl. ..... 347/104; 347/16

(58) Field of Classification Search ..... 347/16, 347/104

See application file for complete search history.

(56) References Cited

U.S. PATENT DOCUMENTS

| | | | | |
|---|---|---|---|---|
| 5,531,436 | A * | 7/1996 | Ohyama et al. | 271/275 |
| 5,794,927 | A * | 8/1998 | Uchida | 271/3.18 |
| 5,821,968 | A | 10/1998 | Ohyama et al. | |
| 2006/0055754 | A1 | 3/2006 | Sakuma et al. | |
| 2006/0164491 | A1 | 7/2006 | Sakuma et al. | |
| 2010/0230890 | A1 * | 9/2010 | Kato | 271/10.1 |

FOREIGN PATENT DOCUMENTS

| | | | |
|---|---|---|---|
| EP | 0535914 | A2 | 4/1993 |
| EP | 0693381 | A1 | 1/1996 |
| JP | S53-129085 | U | 3/1952 |
| JP | S61-124455 | A | 6/1986 |
| JP | H07-133035 | A | 5/1995 |
| JP | H07-156378 | A | 6/1995 |
| JP | H07-330185 | A | 12/1995 |
| JP | 2804715 | B2 | 9/1998 |
| JP | 2004-175494 | A | 6/2004 |

OTHER PUBLICATIONS

European Patent Office; Extended European Search Report in European Patent Application No. 10151694.6 (counterpart to the above-captioned U.S. patent application) mailed May 3, 2010.

Japan Patent Office; Notification of Reasons for Refusal in Japanese Patent Application No. 2009-055948 (counterpart to the above-captioned U.S. patent application) mailed Jan. 18, 2011.

* cited by examiner

*Primary Examiner* — Daniel Petkovsek
(74) *Attorney, Agent, or Firm* — Baker Botts L.L.P.

(57) ABSTRACT

A recording apparatus for forming an image on a recording medium, including: a recording head; a conveyor belt for conveying the medium in a conveyance direction; an attraction device including: a base; a first electrode having first extending portions and a first connecting portion; a second electrode having second extending portions and a second connecting portion; and a protective film provided on the base to cover the electrodes, the attraction device being configured to permit the belt to generate an attractive force to attract the medium to the belt. The first connecting portion and the second connecting portion are located respectively on an upstream side and on a downstream side, of the head, in the conveyance direction. The first electrode and the protective film are bent such that the first connecting portion is located distant from the head by a distance larger than a distance by which the first extending portions are distant from the head.

14 Claims, 5 Drawing Sheets

RECORDING APPARATUS

CROSS REFERENCE TO RELATED APPLICATION

The present application claims priority from Japanese Patent Application No. 2009-055948, which was filed on Mar. 10, 2009, the disclosure of which is herein incorporated by reference in its entirety.

BACKGROUND OF THE INVENTION

1. Field of the Invention

The present invention relates to a recording apparatus configured to form an image on a recording medium.

2. Discussion of Related Art

There is known an ink-jet printer including a recording head configured to eject a liquid such as ink, a conveyor belt configured to convey a sheet (a recording medium) to a position at which the sheet is opposed to the recording head, and an electrostatic-attractive-force generating means configured to permit the conveyor belt to generate an electrostatic attractive force.

In the ink-jet printer described above, the electrostatic-attractive-force generating means includes two electrodes, i.e., an electrode plate and an earth plate, each having a comb-like shape, and an electrode protection film that covers the electrode plate and the earth plate. The electrostatic-attractive-force generating means is configured to permit the conveyor belt to generate the electrostatic attractive force by application of a voltage between the two plates. The sheet is conveyed to a region at which the sheet is opposed to the recording head while being attracted to the conveyor belt by the electrostatic attractive force, and then an image is formed on the sheet by the recording head.

SUMMARY OF THE INVENTION

In the ink-jet printer described above, a connecting portion of the electrode plate that connects a plurality of protruding portions is located at a position where the connecting portion is opposed to the recording head. In the vicinity of the connecting portion, there exist specific areas at each of which a distance between the electrode plate and the earth plate is large. More specifically, each specific area is defined by either one of two corners at the bottom of a recessed portion of the electrode plate that is defined by any adjacent two protruding portions of the electrode plate and a corresponding one of two corners at the top of a protruding portion of the earth plate that is inserted in the recessed portion. A first current path passing through the specific area is longer than a second current path passing through other areas each of which is defined by any one protruding portion of the electrode plate and any one protruding portion of the earth plate that are adjacent to each other so as to be parallel to each other and that extend in the sheet conveyance direction. According to the arrangement, the resistance value in the first current path is larger than the resistance value in the second current path. A Johnsen-Rahbeck force, i.e., an attractive force, to be applied between the conveyor belt and the sheet increases with an increase in the current that flows between the conveyor belt and the sheet. Accordingly, when the resistance value becomes large, the current value inevitably decreases. Therefore, the attractive force in the above-described specific areas where the distance between the electrode plate and the earth plate is large becomes weak as compared with the attractive force in the other areas. Further, the direction of the electric field in the specific areas differs from the direction of the electric field in the above-indicated other areas each of which is defined by any one protruding portion of the electrode plate and any one protruding portion of the earth plate that are adjacent to each other so as to be parallel to each other and that extend in the sheet conveyance direction, undesirably causing instability in the electric field direction. As a result, the liquid ejected from the recording head is influenced by the unstable electric field direction, so that the attaching position at which the liquid is to be attached to the sheet is deviated from an intended position.

Further, the electrode protection film is bonded to the electrode support base so as to be simply placed horizontally. Accordingly, the conveyor belt that is moved and the upstream end of the electrode protection film tend to be rubbed against each other, so that the electrode protection film may peel off away from the electrode support base.

It is therefore an object of the invention to provide a recording apparatus in which an influence of an unstable attractive force on a recording medium and an influence of an unstable electric field direction on ink are suppressed and in which a protective film is prevented from peeling off due to a contact thereof with a conveyor belt.

The above-indicated object may be attained according to a principle of the invention, which provides a recording apparatus for forming an image on a recording medium, comprising:

a recording head configured to eject ink to the recording medium;

a conveyor belt configured to convey the recording medium placed thereon in a medium conveyance direction with the recording medium opposed to the recording head;

an attraction device which is configured to permit the conveyor belt to generate an attractive force to attract the recording medium to the conveyor belt and which includes: (a) a base disposed at a position where the conveyor belt is interposed between the base and the recording head and having a flat surface that faces the recording head; (b) a first electrode which is disposed on the base and which has (b-1) a plurality of first extending portions each of which is disposed on the flat surface so as to extend in the medium conveyance direction and each of which is longer than the recording head in the medium conveyance direction, the plurality of first extending portions being arranged in a direction perpendicular to the medium conveyance direction and (b-2) a first connecting portion that connects the plurality of first extending portions; (c) a second electrode which is disposed on the base and which has (c-1) a plurality of second extending portions each of which is disposed on the flat surface so as to extend in the medium conveyance direction and each of which is longer than the recording head in the medium conveyance direction, the plurality of second extending portions being arranged in the direction perpendicular to the medium conveyance direction and (c-2) a second connecting portion that connects the plurality of second extending portions; and (d) a protective film provided on the base so as to cover the first electrode and the second electrode, the attraction device being configured to generate the attractive force by application of a voltage between the first electrode and the second electrode, wherein the first connecting portion of the first electrode is located on an upstream side of the recording head in the medium conveyance direction while the second connecting portion of the second electrode is located on a downstream side of the recording head in the medium conveyance direction, and wherein the first electrode and the protective film are bent such that the first connecting portion is located distant from the recording head by a distance larger than a distance by which the plurality of first extending portions are distant from the recording head.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIG. 5 shows an attraction device according to a modified embodiment, in which

DETAILED DESCRIPTION OF THE PREFERRED EMBODIMENT

There will be hereinafter described a preferred embodiment of the invention with reference to the drawings.

Figure 1:
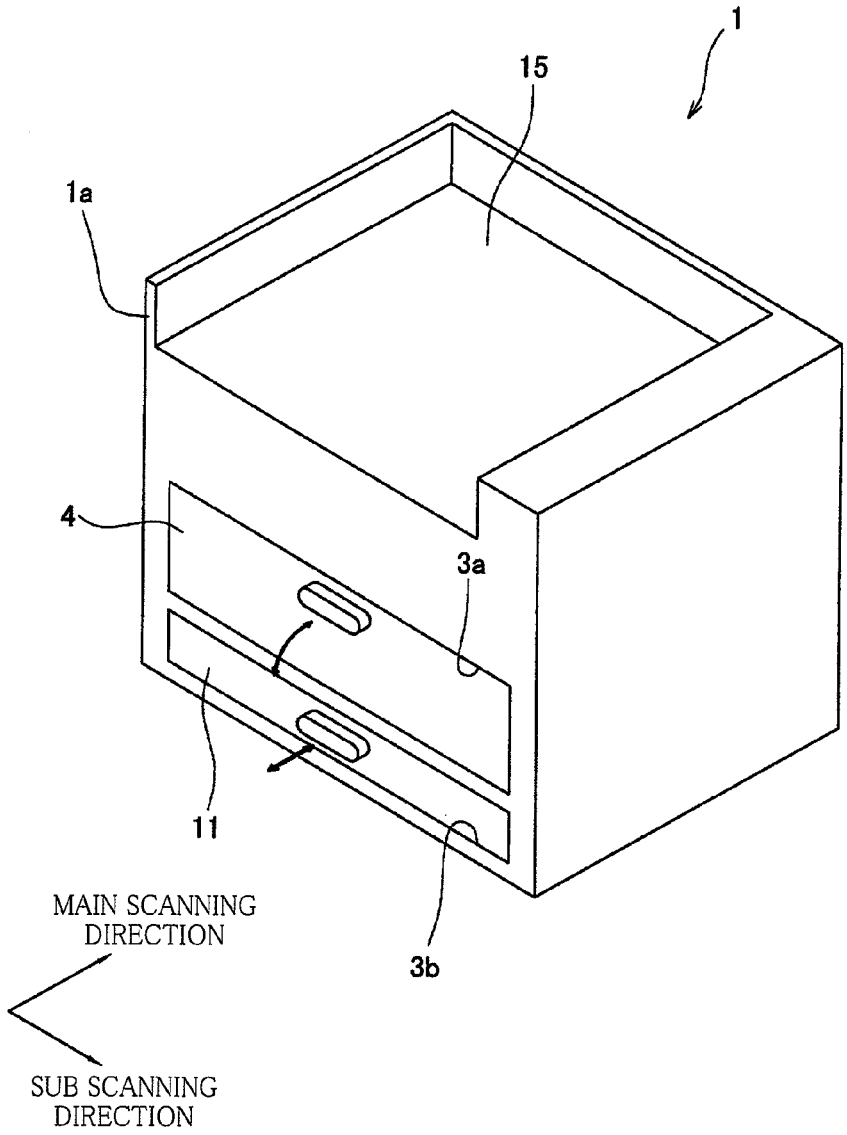
FIG. 1 is a perspective external view of an ink-jet printer according to one embodiment of the invention.

As shown in the perspective view of FIG. 1, an ink-jet printer 1 as a recording apparatus according to the invention has a casing 1*a* which is a rectangular parallelepiped and which has two openings, i.e., upper and lower openings 3*a*, 3*b*, that are formed on the front of the casing 1*a* (on the front surface of the casing 1*a* in FIG. 1). In the opening 3*a*, a door 4 is provided so as to be openable and closable about a horizontal axis located at the lower end of the opening 3*a*. The opening 3*a* and the door 4 are disposed so as to be opposed to a conveyor unit 50 in a depth direction of the casing 1*a*, namely, in a direction perpendicular to the sheet plane of FIG. 2, i.e., in a main scanning direction. In the structure, in an instance where a sheet P (as a recording medium) is jammed on the conveyor unit 50, the user opens the door 4 and the conveyor unit 50 is moved downward by an up/down moving mechanism (not shown), so that a jammed sheet P can be removed.

Figure 2:
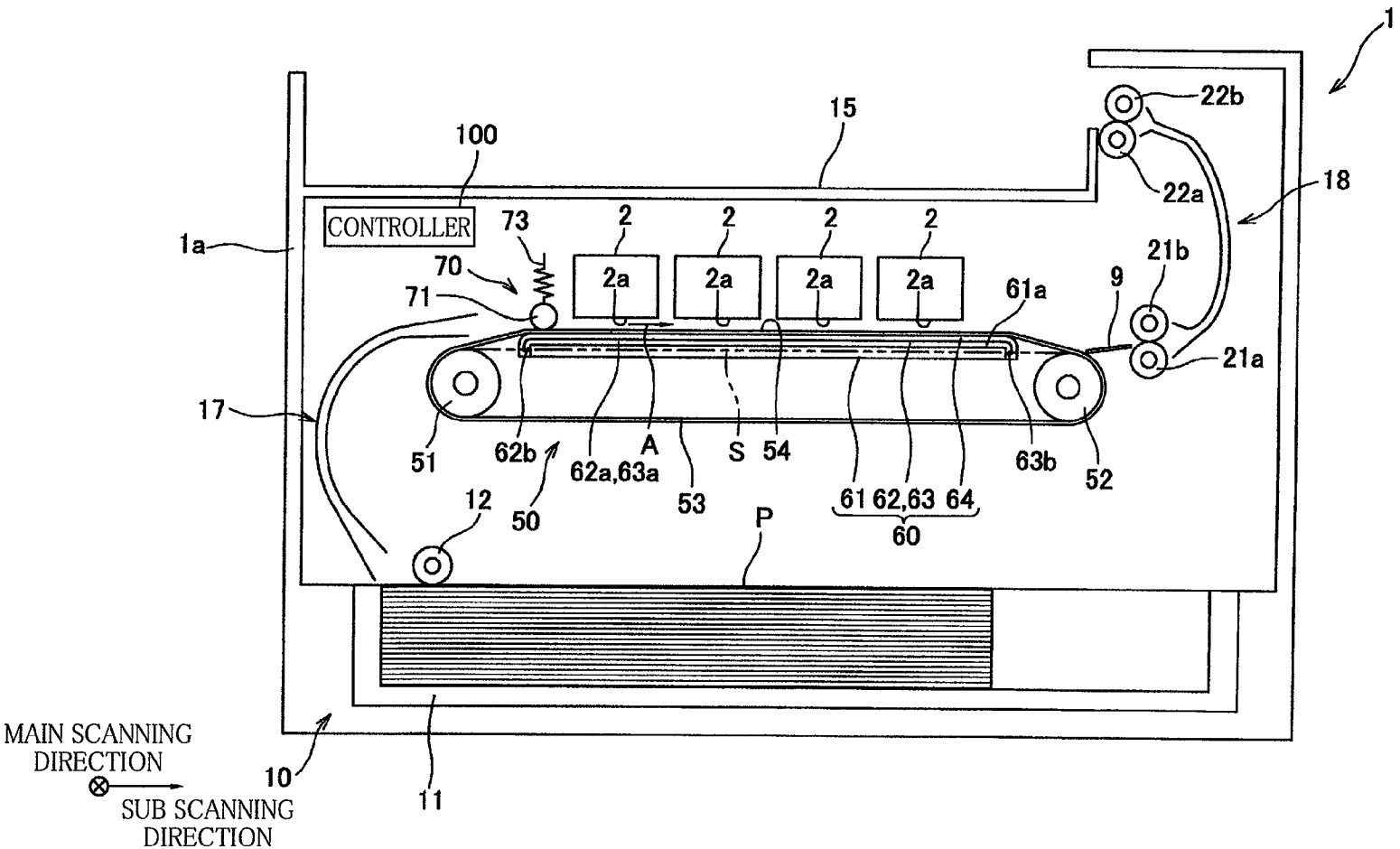
FIG. 2 is a view showing an internal structure of the ink-jet printer of FIG. 1.

As shown in FIG. 2, the ink-jet printer 1 is a color ink-jet printer having four ink-jet heads 2 which respectively eject inks of different colors, i.e., magenta, cyan, yellow, and black. The printer 1 has a sheet supply unit 10 at its lower portion and a discharged-sheet receiving portion 15 at its upper portion. The conveyor unit 50 for conveying the sheet P in a sheet conveyance direction A as a medium conveyance direction is disposed between the sheet supply unit 10 and the discharged-sheet receiving portion 15. The printer 1 further has a controller 100 for controlling operations thereof.

Each of the four ink-jet heads 2 has a generally rectangular parallelepiped shape that is long in the main scanning direction. The four ink-jet heads 2 are arranged in a sub scanning direction. That is, the ink-jet printer 1 is a line-type printer. In the present embodiment, the sub scanning direction is a direction parallel to the sheet conveyance direction A while the main scanning direction is a direction perpendicular to the sub scanning direction and is horizontal, namely, the main scanning direction coincides with the vertical direction in FIG. 3.

Each ink-jet head 2 has a laminar body having: a flow-passage unit in which are formed ink passages that include pressure chambers; and an actuator for giving pressure to ink in the pressure chambers. The flow-passage unit and the actuator (both not shown) are bonded to each other so as to provide the laminar body. The bottom surface of each ink-jet head 2 is formed as an ejection surface 2*a* from which the ink is ejected. In the ejection surface 2*a*, there are formed a plurality of ejection openings (not shown) through which the ink is ejected. The ejection surface 2*a* has a dimension as measured in the main scanning direction that is slightly larger than the dimension of the sheet P as measured in the same direction. Accordingly, it is possible to form an image over the entire surface of the sheet P, namely, it is possible to conduct marginless printing.

As shown in FIG. 2, the sheet supply unit 10 includes a sheet cassette 11 in which a stack of sheets P can be accommodated, a sheet supply roller 12 configured to supply an uppermost one of the sheets P from the sheet cassette 11, and a sheet supply motor (not shown) configured to rotate the sheet supply roller 12. The sheet cassette 11 is disposed so as to be attachable to and detachable from the casing 1*a* through the opening 3*b* in a direction perpendicular to the sheet plane of FIG. 2. In a state in which the sheet cassette 11 is installed on the casing 1*a*, the sheet cassette 11 overlaps the conveyor unit 50 when viewed from the top of the printer 1.

The sheet supply roller 12 is configured to supply the uppermost one of the sheets P from the sheet cassette 11 while being held in rolling contact therewith. The sheet supply motor is controlled by the controller 100. On the left side of the sheet cassette 11 as seen in FIG. 2, there is disposed a sheet guide 17 which extends in a curved form from the sheet cassette 11 toward the conveyor unit 50.

In the structure described above, the sheet supply roller 12 is rotated clockwise in FIG. 2 by being controlled by the controller 100, whereby the sheet P contacting the sheet supply roller 12 is supplied to the conveyor unit 50 through the sheet guide 17.

The conveyor unit 50 includes a pair of belt rollers 51, 52, an endless conveyor belt 53 that is wound around the two belt rollers 51, 52 so as to be stretched therebetween, namely, that is bridged between the two belt rollers 51, 52, a conveyance motor (not shown) configured to rotate the belt roller 52 under the control of the controller 100, and an attraction device 60. The two belt rollers 51, 52 are arranged side by side in the sheet conveyance direction A. The two rollers 51, 52 extend in a direction perpendicular to the sheet conveyance direction A and are parallel to each other.

The conveyor belt 53 is formed of polyimide or fluororesin, for instance, and has flexibility and volume resistivity of about $10^8$-$10^{14}$ Úcm. The conveyor belt 53 may be formed of any other material provided that the material permits the conveyor belt 53 to have the flexibility and the volume resistivity described above.

As shown in FIG. 2, the attraction device 60 is disposed in a region enclosed by the conveyor belt 53 and includes a plate-like base member 61 as a base which is formed of an insulating material and which has a flat upper surface 61*a* as a flat surface, two thin plate-like electrodes 62, 63 bonded to the base member 61 so as to be disposed on the upper surface 61*a*, and a protective film 64 bonded to the base member 61 so as to cover the entirety of the electrodes 62, 63.

The base member 61 is disposed so as to be opposed to the four ink-jet heads 2. The base member 61 is disposed such that its upstream end is located upstream of the most upstream one of the four ink-jet heads 2 in the sheet conveyance direction A while its downstream end is located downstream of the most downstream one of the four ink-jet heads 2 in the sheet conveyance direction A. In other words, the length of the base member 61 as measured in the sub scanning direction is made larger than a distance between an upstream end portion of the most upstream ink-jet head 2 and a downstream end portion of the most downstream ink-jet head 2. Further, the dimension of the base member 61 as measured in the main scanning direction is made substantially equal to the dimension of the belt rollers 51, 52 as measured in the main scanning direction.

As shown in FIG. 2, the base member 61 is disposed such that a distance between the ink-jet heads 2 and the upper surface 61*a* is smaller than a distance between the ink-jet heads 2 and an upper tangent line indicated by "S" in FIG. 2. The upper tangent line S is one of two tangent lines which connect two belt rollers 51, 52 and which are parallel to the sheet conveyance direction A, the one of the two tangent lines being nearer to the ink-jet heads 2, as seen in the direction of extension of the two rollers 51, 52, namely, as seen in a direction perpendicular to the sheet plane of FIG. 2. In other words, the base member 61 is disposed such that the upper surface 61*a* is located at a position where the upper surface 61*a* is distant from the ink-jet heads 2 by a smaller distance than an upper tangent plane that is tangent to both of the rollers 51, 52 is distant from the ink-jet heads 2. The upper tangent plane is one of two tangent planes that are tangent to the rollers 51, 52, which one of the two tangent planes being nearer to the ink-jet heads 2, as seen in the direction of extension of the two rollers 51, 52, namely, as seen in the direction perpendicular to the sheet plane of FIG. 2. According to the arrangement, there exists substantially no clearance between the attraction device 60 and the inner circumferential surface of the upper loop portion of the conveyor belt 53, thereby suppressing a decrease in the attractive force by the attraction device 60 with respect to the sheet P and giving tension to the conveyor belt 53. Further, the attraction device 60 supports the conveyor belt 53 from the inside of the loop, so that the conveyor surface 54 at the upper loop portion of the conveyor belt 53 and the ejection surfaces 2*a* of the ink-jet heads 2 are opposed to each other so as to be in parallel with each other, and there is formed a slight clearance between the ejection surfaces 2*a* and the conveyor surface 54 of the conveyor belt 53. The slight clearance constitutes a part of a sheet transfer or conveyance path through which the sheet P is transferred or conveyed.

Figure 3:
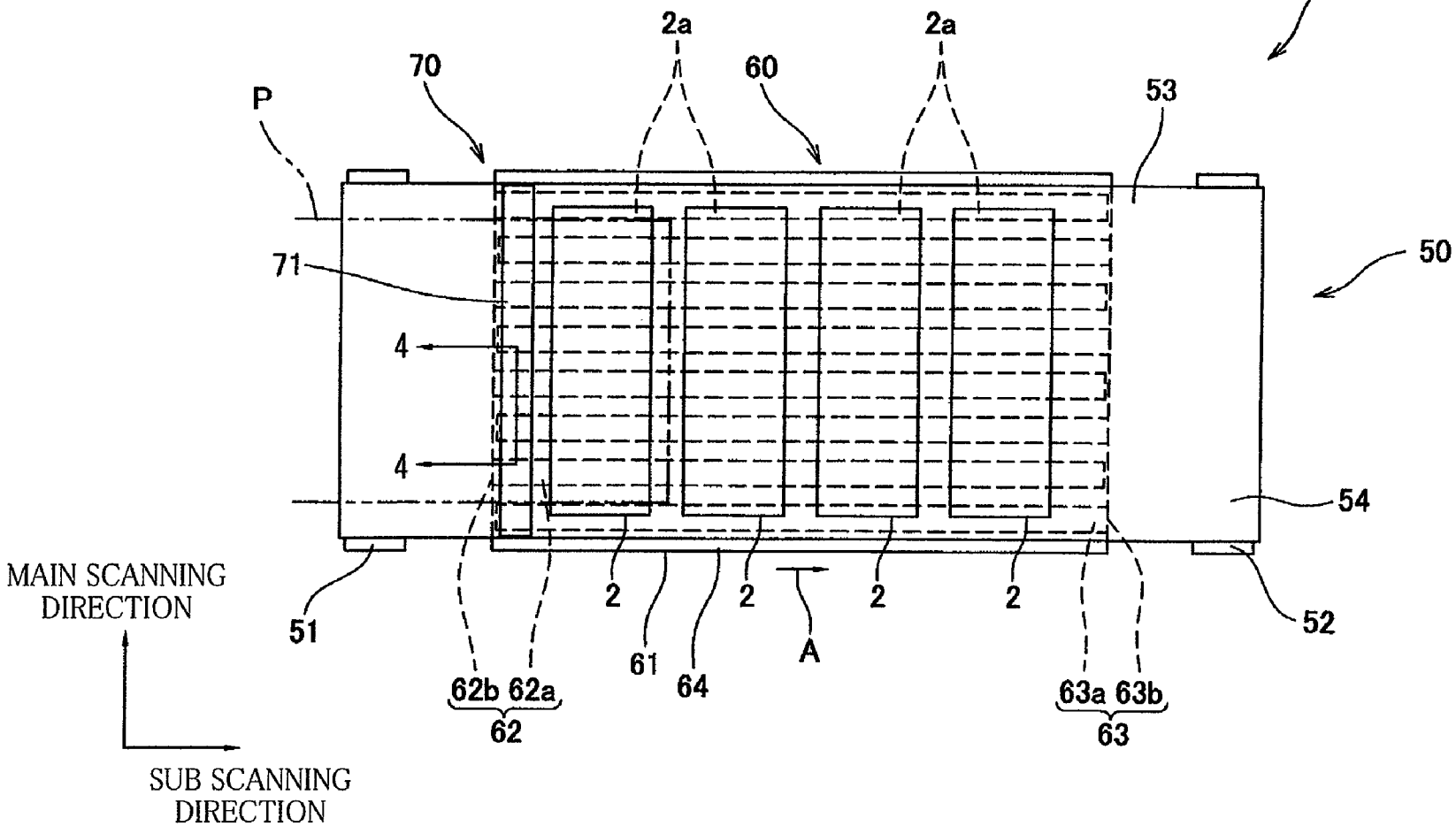
FIG. 3 is a plan view showing four ink-jet heads of FIG. 2 and the vicinity thereof when viewed from the above.
Figure 4A:
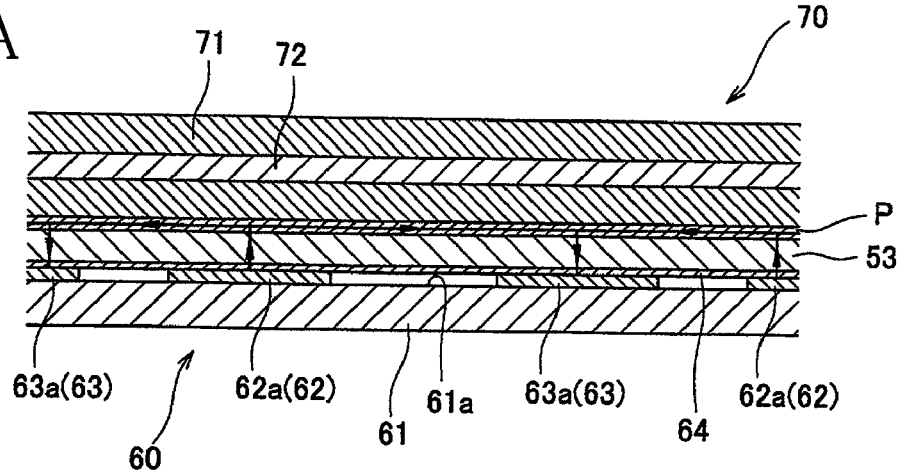
FIG. 4A is a cross sectional view taken along line 4-4 of FIG. 3.
Figure 4B:
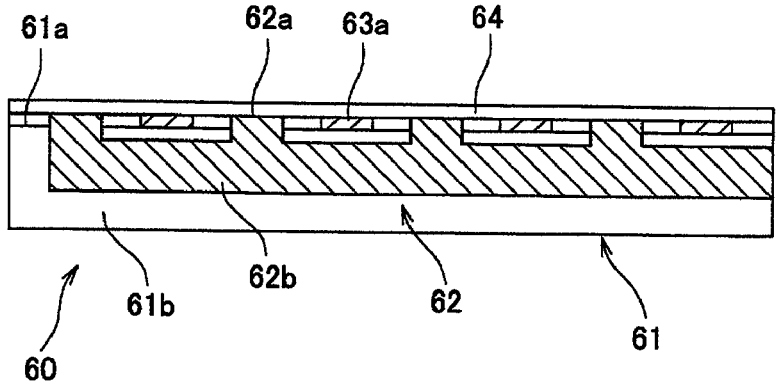
FIG. 4B is a side view showing an attraction device as seen from an upstream side in a sheet conveyance direction.
Figure 4C:
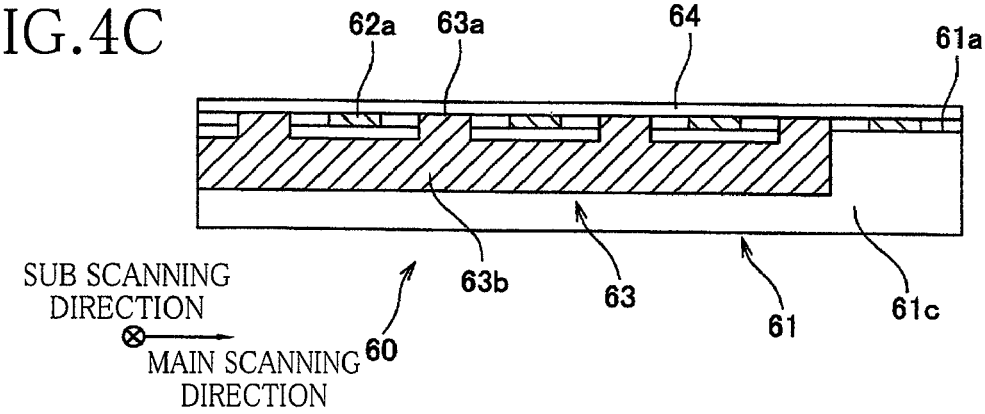
FIG. 4C is a view showing the attraction device as seen from a downstream side in the sheet conveyance direction.

As shown in FIGS. 3 and 4, the electrode 62 as a first electrode includes four extending portions 62*a* each as a first extending portion that extends in the sheet conveyance direction A and a connecting portion 62*b* as a first connecting portion that extends in the main scanning direction so as to connect the extending portions 62*a*. The electrode 62 has a comb-like shape as shown in FIG. 3. Each extending portion 62*a* is disposed such that its downstream end is located in the vicinity of a downstream end portion of the flat surface 61*a* while its upstream end is located at an upstream-side end face 61*b* of the base member 61, in the sheet conveyance direction A. In other words, each extending portion 62*a* has a length as measured in the sub scanning direction that is larger than the distance between the upstream end portion of the most upstream ink-jet head 2 and the downstream end portion of the most downstream ink-jet head 2. Further, each extending portion 62*a* is bent at the vicinity of its upstream end located upstream of the most upstream ink-jet head 2, namely, at a portion thereof that is not opposed to the ink-jet heads 2, such that the upstream end of the extending portion 62*a* is disposed on the upstream-side end face 61*b*, namely, such that the upstream end of the extending portion 62*a* separates away from the ink-jet heads 2. The connecting portion 62*b* is disposed on the upstream-side end face 61*b* so as to be connected to the upstream ends of the respective four extending portions 62*a*.

Like the electrode 62, the electrode 63 as a second electrode includes four extending portions 63*a* each as a second extending portion that extends in the sheet conveyance direction A and a connecting portion 63*b* as a second connecting portion that extends in the main scanning direction so as to connect the extending portions 63*a*. The electrode 63 has a comb-like shape as shown in FIG. 3. The four extending portions 63*a* of the electrode 63 and the four extending portions 62*a* of the electrode 62 are alternately arranged in the main scanning direction as shown in FIG. 3. Each extending portion 63*a* is disposed such that its upstream end is located in the vicinity of an upstream end portion of the flat surface 61*a* while its downstream end is located at a downstream-side end face 61*c* of the base member 61, in the sheet conveyance direction A. In other words, each extending portion 63*a* has a length as measured in the sub scanning direction that is larger than the distance between the upstream end portion of the most upstream ink-jet head 2 and the downstream end portion of the most downstream ink-jet head 2. Further, each extending portion 63*a* is bent at the vicinity of its downstream end located downstream of the most downstream ink-jet head 2, namely, at a portion thereof that is not opposed to the ink-jet heads 2, such that the downstream end of the extending portion 63*a* is disposed on the downstream-side end face 61*c*, namely, such that the downstream end of the extending portion 63*a* separates away from the ink-jet heads 2. The connecting portion 63*b* is disposed on the downstream-side end face 61*c* so as to be connected to the downstream ends of the respective four extending portions 63*a*. Since the connecting portions 62*b*, 63*b* are disposed on the upstream-side end face 61*b* and the downstream-side end face 61*c*, respectively, the size or dimension of the base member 61 can be reduced in the sheet conveyance direction A. The connecting portions 62*b*, 63*b* of the respective two electrodes 62, 63 are connected to a power source, not shown, that is controlled by the controller 100.

The protective film 64 is formed of polyimide or fluororesin, for instance, and has volume resistivity of about $10^8$-$10^{14}$ Úcm. The protective film 64 may be formed of any other material provided that the material permits the protective film 64 to have the volume resistivity described above. The protective film 64 is disposed so as to cover the entirety of the upper surface 61*a*, the upstream-side end face 61*b*, and the downstream-side end face 61*c*, namely, so as to cover the entirety of the two electrodes 62, 63. In other words, the protective film 64 is bent, together with the extending portions 62*a*, 63*a*, at a position corresponding to a connection between the upper surface 61*a* and the upstream-side end face 61*b* (i.e., the upstream end portion of the upper surface 61*a* located upstream of the most upstream ink-jet head 2) and at a position corresponding to a connection between the upper surface 61*a* and the downstream-side end face 61*c* (i.e., the downstream end portion of the upper surface 61*b* located downstream of the most downstream ink-jet head 2). Accordingly, the upstream end portion and the downstream end portion of the protective film 64 are disposed so as to be opposed to the upstream-side end face 61*b* and the downstream-side end face 61*c*, respectively. The bent portions of the protective film 64 which respectively cover the bent portions of the extending portions 62*a* and the bent portions of the extending portions 63*a* are rounded as shown in FIG. 2, whereby the protective film 64 is hard to peel off away from the base member 61 even if the bent portions of the protective film 64 come into contact with the conveyor belt 53.

As shown in FIGS. 2-4, a pressing mechanism 70 configured to press the sheet P onto the conveyor surface 54 is disposed at a position which is upstream of the most upstream ink-jet head 2 in the sheet conveyance direction A, so as to be opposed to the upstream sections of the respective extending portions 62*a*, 63*a*. The pressing mechanism 70 includes a roller 71 which is long in the main scanning direction, a shaft member 72 which rotatably supports the roller 71, and biasing members 73 which biased the roller 71 toward the conveyor belt 53.

The length of the roller 71 as measured in the main scanning direction is substantially the same as the width of the conveyor belt 53. Each of the biasing members 73 is formed of an elastic member such as a spring. The biasing members 73 are connected to respective opposite axial ends of the shaft member 72. In the arrangement, the sheet P supplied from the sheet supply unit 10 can be pressed onto the conveyor surface 54.

In the structure described above, the belt roller 52 is rotated clockwise in FIG. 2 under the control of the controller 100, whereby the conveyor belt 53 is moved or rotated. On this occasion, the belt roller 51 and the roller 71 are also rotated in accordance with the rotary movement of the conveyor belt 53.

Further, on this occasion, there are given, under the control of the controller 100, mutually different potentials to the two electrodes 62, 63, namely, a positive or negative potential is given to the electrode 62 while a ground potential is given to the electrode 63. The potential given to the electrode 62 is 1 kV, for instance. When the potentials are thus given to the respective two electrodes 62, 63, the current flows as indicated by the arrows in FIG. 4A. More specifically, the current flows from the electrode 62 (the extending portions 62*a*) to the sheet P through the protective film 64 and the conveyor belt 53 and flows from the sheet P to the electrode 63 (the extending portions 63*a*) through the conveyor belt 53 and the protective film 64, and positive or negative electric charge is generated at a portion of the conveyor belt 53 facing the sheet P while electric charge whose polarity is opposite to that of the above-indicated electric charge is induced at the surface of the sheet P facing the conveyor belt 53. The electric charge generated on the conveyor belt 53 and the electric charge generated on the sheet P are attracted to each other, whereby there is generated the attractive force (Johnsen-Rahbeck force) by which the sheet P is attracted to the conveyor belt 53.

In the present embodiment, the connecting portions 62*b*, 63*b* do not exist and only the extending portions 62*a*, 63*a* exist, at the position at which the two electrodes 62, 63 are opposed to the four ink-jet heads 2, as shown in FIG. 3. In other words, even where the potentials are given to the respective extending portions 62*a*, 63*a*, there are generated a uniform attractive force and an electric field in the same direction, throughout the printing region by the four ink-jet heads 2. Accordingly, it is possible to suppress the influence of the unstable attractive force on the sheet P and to suppress the influence of the unstable electric field direction on the ink ejected from the ink-jet heads 2. Moreover, the extending portions 62*a*, 63*a* are bent such that the connecting portions 62*b*, 63*b* which respectively connect the extending portions 62*a*, 63*a* separate away from the ink-jet heads 2. It is therefore possible to more effectively suppress the influence of the unstable attractive force on the sheet P and to more effectively suppress the influence of the unstable electric field direction on the ink ejected from the ink-jet heads 2, than in an instance where the connective portions 62*b*, 63*b* are disposed at a position at which the connecting portions 62*b*, 63*b* are opposed to the four ink-jet heads 2 on the same plane as the extending portions 62*a*, 63*a*. Accordingly, the sheet P supplied from the sheet supply unit 10 is conveyed in the sheet conveyance direction A while being attracted to the conveyor surface 54 owing to the uniformly generated attractive force.

When the sheet P conveyed by the conveyor belt 53 while being attracted to the conveyor surface 54 of the conveyor belt 53 passes right below the four ink-jet heads 2, the ink-jet heads 2 controlled by the controller 100 eject the respective different colors of inks toward the sheet P. On this occasion, the ejected ink is not influenced by the unstable electric field direction, so that a high-quality color image can be formed on the sheet P.

A separation member 9 is disposed on the immediately downstream side of the conveyor unit 50 in the sheet conveyance direction A. The separation member 9 is configured to separate the sheet P from the conveyor surface 54 such that the edge of the separation member 9 is inserted between the sheet P and the conveyor belt 53. At a time point when the leading end of the sheet P reaches the separation member 9, the attractive force between the conveyor surface 54 and the leading end of the sheet P has weakened, so that the sheet P is separated from the conveyor surface 54 by the separation member 9.

At a portion of the sheet transfer path between the conveyor unit 50 and the discharged-sheet receiving portion 15, there are disposed: four feed rollers 21*a*, 21*b*, 22*a*, 22*b*; and a sheet guide 18 located between the feed rollers 21*a*, 21*b* and the feed rollers 22*a*, 22*b*. The feed rollers 21*b*, 22*b* are rotatably driven by a feed motor (not shown) controlled by the controller 100. In the arrangement described above, the feed rollers 21*b*, 22*b* are rotated under the control of the controller 100, whereby the sheet P conveyed by the conveyor unit 50 is transferred upward in FIG. 2 through the sheet guide 18 while being held by the feed rollers 21*a*, 21*b*. Subsequently, the sheet P is transferred to the discharged-sheet receiving portion 15 while being held by the feed rollers 22*a*, 22*b*. The feed rollers 21*a*, 22*a* are driven rollers configured to be rotated as the sheet is transferred.

As explained above, in the ink-jet printer 1 according to the present embodiment, it is possible to reduce the influence of the unstable attractive force on the sheet P generated in the vicinity of the connecting portions 62*b*, 63*b* and the influence of the unstable electric field direction on the inks ejected from the respective ink-jet heads 2, resulting in improvement of the image quality. Further, even where the conveyor belt 53 and the protective film 64 of the attraction device 60 are in contact with each other while the sheet P is being conveyed, the protective film 64 is hard to peel off away from the base member 61 because the upstream end portion of the protective film 64 is present on the upstream-side end face 61*b* of the base member 61 and does not contact the conveyor belt 53.

Figure 5A:
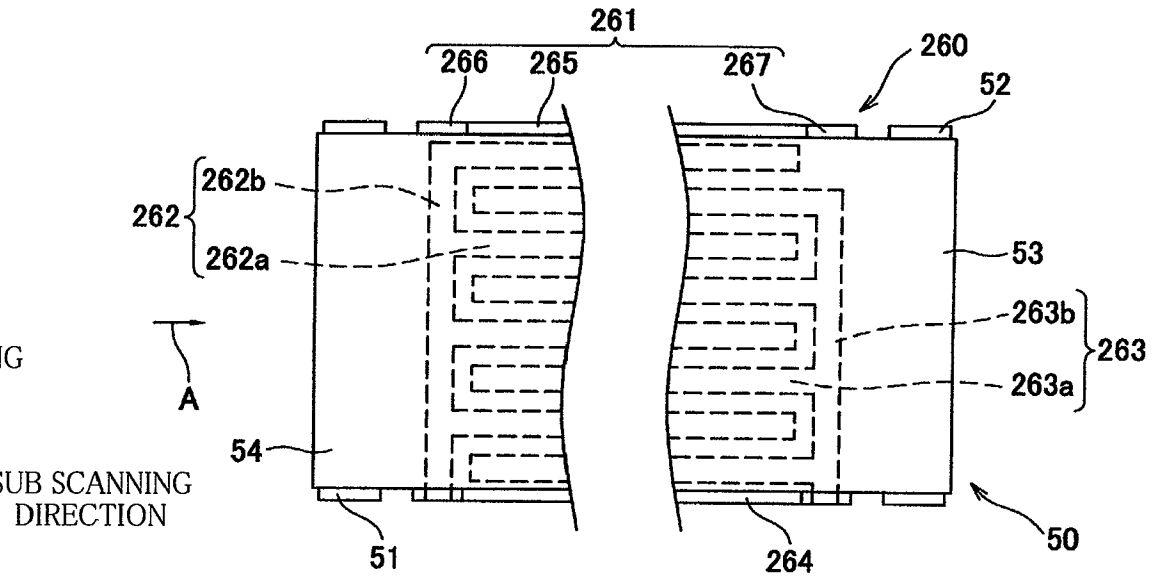
FIG. 5A is a plan view showing the conveyor unit and the attraction device when viewed from the above and FIG. 5B is a front view showing the conveyor unit and the attraction device.
Figure 5B:
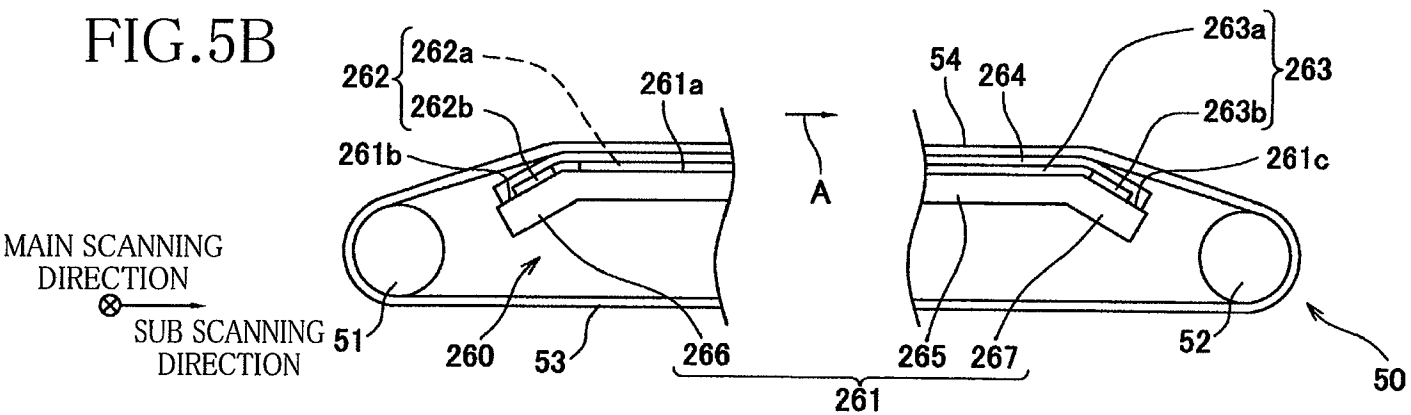

There will be next explained a modified embodiment with reference to FIG. 5. An attraction device 260 shown in FIG. 5 may be employed in the ink-jet printer 1. The attraction device 260 includes a base member 261 as the base, two electrodes 262, 263 as the first electrode and the second electrode, respectively, which are bonded to the base member 261, and a protective film 264 bonded to the base member 261 so as to cover the entirety of the two electrodes 262, 263. The base member 261 is formed of an insulating material and includes: a flat portion 265 having a flat upper surface 261*a* as the flat surface; and two inclined portions 266, 267 each of which is connected to a corresponding one of opposite ends of the flat portion 265 in the sheet conveyance direction A.

The flat portion 265 is disposed similarly in position to the base member 61 and has the same size as the base member 61. The two inclined portions 266, 267 has respective inclined surfaces 261*b*, 261*c* which are distant from the ink-jet heads 2 by a larger distance than the upper surface 261*a* is distant from the ink-jet heads 2. In other words, the inclined surfaces 261*b*, 261*c* are inclined downwardly.

Like the above-described electrode 62, the electrode 262 as the first electrode has four extending portions 262*a* each as the first extending portion and a connecting portion 262*b* as the first connecting portion which connects the extending portions 262*a*. The electrode 262 has a comb-like shape as shown in FIG. 5. Each extending portion 262*a* is disposed such that its downstream end is located in the vicinity of a downstream end portion of the flat surface 261*a* while its upstream end is located at the inclined surface 261*b*, in the sheet conveyance direction A. In other words, each extending portion 262*a* has a length as measured in the sub scanning direction that is larger than the distance between the upstream end portion of the most upstream ink-jet head 2 and the downstream end portion of the most downstream ink-jet head 2. Further, each extending portion 262*a* is bent at the vicinity of its upstream end located upstream of the most upstream ink-jet head 2, namely, at a portion thereof that is not opposed to the ink-jet heads 2, such that the upstream end of the extending portion 262*a* is disposed on the inclined surface 261*b*, namely, such that the upstream end of the extending portion 262*a* separates away from the ink-jet heads 2. The connecting portion 262*b* is disposed on the inclined surface 261*b* so as to be connected to the upstream ends of the respective four extending portions 262*a*.

Like the above-indicated electrode 63, the electrode 263 as the second electrode includes four extending portions 263*a* each as the second extending portion and a connecting portion 263*b* as the second connecting portion which connects the extending portions 263*a*. The electrode 263 has a comb-like shape as shown in FIG. 5. The four extending portions 263*a* of the electrode 263 and the four extending portions 262*a* of the electrode 262 are alternately arranged in the main scanning direction as shown in FIG. 5. Each extending portion 263*a* is disposed such that its upstream end is located in the vicinity of an upstream end portion of the flat surface 261*a* while its downstream end is located at the inclined surface 261*c*, in the sheet conveyance direction A. In other words, each extending portion 263*a* has a length as measured in the sub scanning direction that is larger than the distance between the upstream end portion of the most upstream ink-jet head 2 and the downstream end portion of the most downstream ink-jet head 2. Further, each extending portion 263*a* is bent at the vicinity of its downstream end located downstream of the most downstream ink-jet head 2, namely, at a portion thereof that is not opposed to the ink-jet heads 2, such that the downstream end of the extending portion 263*a* is disposed on the inclined surface 261*c*, namely, such that the downstream end of the extending portion 263*a* separates away from the ink-jet heads 2. The connecting portion 263*b* is disposed on the inclined surface 261*c* so as to be connected to the downstream ends of the respective four extending portions 263*a*. Like the connecting portions 62*b*, 63*b* in the illustrated embodiment, the connecting portions 262*b*, 263*b* of the respective two electrodes 262, 263 are connected to the power source, not shown.

The protective film 264 is formed of a material similar to that of the above-described protective film 64 and is disposed on the upper surface 261*a* and the inclined surfaces 261*b*, 261*c* so as to cover the entirety of the electrodes 262, 263. In other words, the protective film 264 is bent, together with the extending portions 262*a*, 263*a*, at a position corresponding to a connection between the upper surface 261*a* and the inclined surface 261*b* (i.e., the upstream end portion of the upper surface 261*a* located upstream of the most upstream ink-jet head 2) and at a position corresponding to a connection between the upper surface 261*a* and the inclined surface 261*c* (i.e., the downstream end portion of the upper surface 261*b* located downstream of the most downstream ink-jet head 2). Accordingly, the upstream end portion and the downstream end portion of the protective film 264 are disposed so as to be opposed to the upstream end portion of the inclined surface 261*b* and the downstream end portion of the inclined surface 261*c*, respectively. The bent portions of the protective film 264 are rounded as shown in FIG. 5, whereby the protective film 264 is hard to peel off away from the base member 261 even if the bent portions of the protective film 264 come into contact with the conveyor belt 53.

As in the illustrated embodiment, in the thus constructed attraction device 260, when mutually different potentials are given to the respective two electrodes 262, 263, the uniform attractive force and the electric field in the same direction are generated at a portion of the conveyor belt 53 that is opposed to the upper surface 261*a*, namely, at a portion of the conveyor belt 53 corresponding to the printing region by the four ink-jet heads 2. Accordingly, it is possible to effectively suppress the influence of the unstable attractive force on the sheet P and to suppress the influence of the unstable electric field direction on the ink ejected from the ink-jet heads 2. In the attraction device 260 constructed as described above, the bending angle of the extending portions 262*a*, 263*a* can be made more gentle than that of the extending portions 62*a*, 63*a* of the illustrated embodiment, whereby the extending portions 262*a*, 263*a* are hard to be ruptured.

While the preferred embodiment of the invention and the modification thereof have been described by reference to the accompanying drawings, it is to be understood that the invention is not limited to the details of the illustrated embodiment and its modification, but may be embodied with various changes and modifications, which may occur to those skilled in the art, without departing from the scope of the invention defined in the attached claims. In the illustrated embodiment and the modified embodiment, the extending portions 63*a*, 263*a* are bent such that the connecting portions 63*b* 263*b* separate away from the ink-jet heads 2. The extending portions 63*a*, 263*a* may not be bent. In this instance, it is desirable that the connecting portions 63*b*, 263*b* be located at a region where the connecting portions 63*b*, 263*b* are not opposed to the ink-jet heads 2. The bent portions of the protective films 64, 264 may not be rounded. Further, the attraction devices 60, 260 may be disposed at a position where the protective films 64, 264 are in contact with the inner circumferential surface of the upper loop portion of the conveyor belt 53 so as not to give tension to the conveyor belt 53.

The ground potential may be given to the electrodes 62, 262 while the positive or negative potential may be given to the electrodes 63, 263. Further, one of the positive and negative potentials may be given to the electrodes 62, 262 while the other of the positive and negative potential may be given to the electrodes 63, 263. The principle of the invention may be applicable to any other recording apparatus that employ recording heads other than the ink-jet head.

What is claimed is:

1. A recording apparatus for forming an image on a recording medium, comprising:

a recording head configured to eject ink to the recording medium;

a conveyor belt configured to convey the recording medium placed thereon in a medium conveyance direction with the recording medium opposed to the recording head;

an attraction device which is configured to permit the conveyor belt to generate an attractive force to attract the recording medium to the conveyor belt and which includes: (a) a base disposed at a position where the conveyor belt is interposed between the base and the recording head and having a flat surface that faces the recording head; (b) a first electrode which is disposed on the base and which has (b-1) a plurality of first extending portions each of which is disposed on the flat surface so as to extend in the medium conveyance direction and each of which is longer than the recording head in the medium conveyance direction, the plurality of first extending portions being arranged in a direction perpendicular to the medium conveyance direction and (b-2) a first connecting portion that connects the plurality of first extending portions; (c) a second electrode which is disposed on the base and which has (c-1) a plurality of second extending portions each of which is disposed on the flat surface so as to extend in the medium conveyance direction and each of which is longer than the recording head in the medium conveyance direction, the plurality of second extending portions being arranged in the direction perpendicular to the medium conveyance direction such that each of the plurality of first extending portions and each of the plurality of second extending portions are alternately arranged and (c-2) a second connecting portion that connects the plurality of second extending portions; and (d) a protective film provided on the base so as to cover the first electrode and the second electrode, the attraction device being configured to generate the attractive force by application of a voltage between the first electrode and the second electrode, wherein the first connecting portion of the first electrode is located on an upstream side of the recording head in the medium conveyance direction while the second connecting portion of the second electrode is located on a downstream side of the recording head in the medium conveyance direction, and wherein the first electrode and the protective film are bent such that the first connecting portion is located distant from the recording head by a distance larger than a distance by which the plurality of first extending portions are distant from the recording head, and wherein the first connecting portion extends in a portion of the first electrode in which the first electrode is bent.

2. The recording apparatus according to claim 1, wherein the first connecting portion is disposed on an upstream-side end face of the base in the medium conveyance direction.

3. The recording apparatus according to claim 1, wherein the base has an upstream-side inclined surface which is located on an upstream side of the flat surface in the medium conveyance direction so as to be contiguous to the flat surface and which is inclined so as to gradually separate away from the recording head in a direction toward the upstream side, and wherein the first connecting portion is disposed on the upstream-side inclined surface.

4. The recording apparatus according to claim 1, wherein a part of the protective film that covers the bent portion of the first electrode is rounded.

5. The recording apparatus according to claim 1, wherein the second electrode and the protective film are bent such that the second connecting portion is located distant from the recording head by a distance larger than a distance by which the plurality of second extending portions are distant from the recording head.

6. The recording apparatus according to claim 5, wherein the second connecting portion is disposed on a downstream-side end face of the base in the medium conveyance direction.

7. The recording apparatus according to claim 5, wherein the base has a downstream-side inclined surface which is located on a downstream side of the flat surface in the medium conveyance direction so as to be contiguous to the flat surface and which is inclined so as to gradually separate away from the recording head in a direction toward the downstream side, and wherein the second connecting portion is disposed on the downstream-side inclined surface.

8. The recording apparatus according to claim 5, wherein a part of the protective film that covers the bent portion of the second electrode is rounded.

9. The recording apparatus according to claim 5, wherein the first connecting portion and the second connecting portion are respectively disposed on an upstream-side end face and a downstream-side end face of the base in the medium conveyance direction.

10. The recording apparatus according to claim 5, wherein the base has: an upstream-side inclined surface which is located on an upstream side of the flat surface in the medium conveyance direction so as to be contiguous to the flat surface and which is inclined so as to gradually separate away from the recording head in a direction toward the upstream side; and a downstream-side inclined surface which is located on a downstream side of the flat surface in the medium conveyance direction so as to be contiguous to the flat surface and which is inclined so as to gradually separate away from the recording head in a direction toward the downstream side, and wherein the first connecting portion and the second connecting portion are disposed on the upstream-side inclined surface and the downstream-side inclined surface, respectively.

11. The recording apparatus according to claim 5, wherein a part of the protective film that covers the bent portion of the first electrode and a part of the protective film that covers the bent portion of the second electrode are rounded.

12. The recording apparatus according to claim 1, further comprising a pair of rollers between which the conveyor belt is bridges, wherein the base is disposed between the pair of rollers such that the flat surface is located at a position where the flat surface is distant from the recording head by a distance that is smaller than a distance by which a tangent plane that is tangent to both of the pair of rollers is distant from the recording head.

13. The recording apparatus according to claim 1, comprising a plurality of recording heads each as the recording head which are arranged in the medium conveyance direction, wherein the first connecting portion of the first electrode is located on an upstream side of the most upstream one of the plurality of recording heads in the medium conveyance direction while the second connecting portion of the second electrode is located on a downstream side of the most downstream one of the plurality of recording heads in the medium conveyance direction.

14. The recording apparatus according to claim 1, wherein the second electrode and the protective film are bent such that the second connecting portion is located distant from the recording head by a distance larger than a distance by which the plurality of second extending portions are distant from the recording head, wherein a position at which the first electrode and the protective film are bent is a position at which upstream ends of the plurality of second extending portions are located in the medium conveyance direction, and wherein a position at which the second electrode and the protective film are bent is a position at which downstream ends of the plurality of first extending portions are located in the medium conveyance direction.

* * * * *